United States Patent [19]

Suzuki et al.

[11] Patent Number: 4,688,624

[45] Date of Patent: Aug. 25, 1987

[54] APPARATUS FOR HORIZONTAL CONTINUOUS CASTING OF METAL

[75] Inventors: Kengi Suzuki; Tadanao Itoh; Hiroshi Mitsuhashi; Yuichi Ozawa, all of Kitakata; Sadao Hasegawa, Fukushima; Takeshi Yamauchi, Kitakata, all of Japan

[73] Assignee: Showa Aluminum Industries K.K., Tokyo, Japan

[21] Appl. No.: 907,908

[22] Filed: Sep. 16, 1986

Related U.S. Application Data

[62] Division of Ser. No. 757,096, Jul. 19, 1985.

[30] Foreign Application Priority Data

Jul. 27, 1984 [JP] Japan ..... 59-155427
Sep. 14, 1984 [JP] Japan ..... 59-191752

[51] Int. Cl.[4] ..... B22D 11/10
[52] U.S. Cl. ..... 164/440; 164/437
[58] Field of Search ..... 164/490, 440, 472, 473, 164/475, 415, 436, 418, 437

[56] References Cited

U.S. PATENT DOCUMENTS

| | | |
|---|---|---|
| 2,996,771 | 8/1961 | Armand et al. . |
| 3,286,309 | 11/1966 | Brondyke et al. . |
| 3,455,369 | 7/1969 | Craig et al. . |
| 3,556,197 | 1/1971 | Foye et al. . |
| 3,630,266 | 12/1971 | Watts . |

FOREIGN PATENT DOCUMENTS

| | | |
|---|---|---|
| 39-23710 | 6/1964 | Japan . |
| 45-41509 | 6/1970 | Japan . |
| 46-28889 | 6/1971 | Japan . |
| 305006 | 5/1970 | U.S.S.R. . |

*Primary Examiner*—Nicholas P. Godici
*Assistant Examiner*—G. M. Reid
*Attorney, Agent, or Firm*—Armstrong, Nikaido, Marmelstein & Kubovcik

[57] ABSTRACT

In the horizontal continuous casting of metal, an upper contact part and a lower contact part of the metal body are horizontally displaced with the inner wall of the tubular chilled mold relative to one another, so that the lower contact part is psoitioned downstream relative to the upper contact part.

1 Claim, 16 Drawing Figures

APPARATUS FOR HORIZONTAL CONTINUOUS CASTING OF METAL

This is a division of application Ser. No. 757,096, filed July 19, 1985.

BACKGROUND OF THE INVENTION

1. Field of the Invention

The present invention relates to an improved method and apparatus for horizontal continuous casting of metal, particularly light metal, such as aluminum and its alloys.

2. Description of Prior Art

In horizontal continuous casting, a long ingot is usually produced by the following procedure. Molten metal is admitted into and maintained in a tundish. It is then fed via a refractory channel into a tubular chilled mold which is placed in a substantially horizontal position and which is drastically cooled. The molten metal is cooled in the tubular chilled mold so that the outer surface of the molten metal body forms a solidified shell. The molten metal body having the solidified shell is continuously withdrawn from the tubular chilled mold during cooling by directly impinging a coolant, e.g., water upon the metal body. During the continuous withdrawal, the solidification proceeds until the interior of the strand. The ingot produced may be cylindrical, rectangular, columnar, or hollow depending upon the shape of the mold.

Horizontal continuous casting inevitably involves various difficulties due to its inherent principle. The first difficulty results from the horizontal position of the mold. The molten metal in the mold presses against the lower part of the mold wall due to gravity, resulting in unbalanced cooling, i.e., strong and weak cooling at the lower and upper parts of the mold, respectively. Because of this unbalanced cooling, the center of the concave or convex solid-liquid interface where the solidification is completed, is liable to distort upward. In this case, the structure of the strand becomes non-homogeneous.

The second difficulty results from the lubricating oil introduced from the inner circumferential wall of the mold at its entry side to prevent the molten metal from sticking to the mold. If the lubricating oil is introduced uniformly from the entire inner circumferential part of the mold wall at its entry side, the lubricating oil is liable to flow down from the upper to lower inner circumferential part of the mold wall, resulting in a non-uniform lubricating surface.

The third difficulty also results from the horizontal position of the mold. Since the molten metal is in close contact with the lower part of the mold wall due to gravity, there tends to be insufficient clearance for the lubricating oil to flow in between the mold wall and the solidified shell. In the case of a poor lubrication, the solidified shell will break and the unsolidified molten metal will flow out through the break. The flow of molten metal, called "breakout", causes significant cast defects and, in a serious case, stops the casting operation.

Several proposals have been heretofore made to overcome the difficulties of horizontal continuous casting.

Japanese Examined Patent Publication (Kokoku) No. 39-23710 (U.S. Pat. No. 2,996,771) proposes to locate the orifice aperture of the mold for feeding the molten metal below the central axis of the mold.

Japanese Examined Patent Publication No. 45-41509 (U.S. Pat. No. 3,455,369) proposes to fit an annular mandrel at the metal-entry aperture of the mold.

The proposals made in the above two Japanese patent publications disclose to direct downward the high-temperature stream of molten metal at the entry part of the mold, thereby mitigating the cooling at the lower part of the mold wall. These proposals are effective for aligning the solidification point, which is the most distant from the entry part of the mold, toward the central axis of the mold. Nevertheless, the above-described strong contact of molten metal with the lower part of the mold wall is not solved by these proposals. These proposals are, therefore, ineffective for obtaining a homogeneous cast structure.

Japanese Examined Patent Publication No. 46-28889 (U.S. Pat. No. 3,556,197) proposes a non-uniform distribution of the amount of lubricating oil at the upper and lower parts of the mold-wall. With this method, however, a uniform lubricating surface is difficult to form even when a considerably large amount of lubricating oil is supplied to the mold wall. In addition, the non-uniform distribution of lubricating oil results in cast defects, referred to as "oil folds", in the case of locally feeding an extremely great amount of lubricating oil.

SUMMARY OF THE INVENTION

It is an object of the present invention to provide an improved method for horizontal continuous casting overcoming the above-described difficulties, i.e., the unbalanced cooling of a metal body at its upper and lower parts in the tubular chilled mold and non-uniform lubrication over the inner wall of the tubular chilled mold.

The method according to the present invention, comprises: maintaining molten metal in a tundish having an outlet; continuously feeding the molten metal from the outlet of the tundish to a tubular chilled mold having open ends, an inner wall and a central axis extending essentially horizontally; passing the molten metal through a refractory header plate which is placed between the tundish and the tubular chilled mold and has a passageway to the tubular chilled mold; holding the molten metal within the tubular chilled mold to form a metal body having a columnar or hollow form; extracting heat from the metal body from its contact parts with the inner wall of the tubular chilled mold to cool the metal body; forming a lubricating surface on the inner wall of the tubular chilled mold on at least the parts where the metal body is in contact therewith; withdrawing a solidified or partially solidified ingot formed in the tubular chilled mold through the open end at a downstream position; and horizontally displacing an upper contact part and a lower contact part of the metal body with the inner wall of the tubular chilled mold relative to one another, so that the lower contact part is positioned downstream relative to the upper contact part, thereby suppressing cooling of the lower part relative to the upper part.

The apparatus according to the present invention comprises: a tundish for maintaining molten metal, having an outlet; a tubular chilled mold having open ends, one of the open ends being communicated with the outlet of the tundish, an axis extending essentially horizontally, and an inner wall; refractory header plate which is placed between the tundish and the tubular chilled mold and has a passageway to the tubular chilled mold; and a means for horizontally displacing an upper contact part and a lower contact part of the molten metal with the inner wall of the tubular chilled mold relative to one another, so that the lower contact part is positioned downstream relative to the upper part.

The lower contact part mentioned above is beneath the horizontal plane across the central axis.

DESCRIPTION OF THE PREFERRED EMBODIMENTS

The "metal body" as used herein is metal provided with a shape predetermined by the tubular chilled mold. The metal body may consist of melt or a solid or partially solidified body having a solidified shell over the outer surface.

The ingot produced by the method of the present invention is used mainly for extrusion or drawing in a case of a cylindrical ingot, referred to as a billet, and for rolling in a case of a rectangular ingot, referred to as a slab. The ingot may be hollow and columnar. The hollow, columnar ingot is used as a blank material for producing a tube.

According to the present invention, the lower contact part of the metal body is positioned downstream relative to the upper contact part. Such relative positioning can be realized by any means for preventing the contact of the metal body with the inner wall of the tubular chilled mold at the immediate proximity of the corner which is formed by the refractory header plate and the tubular chilled mold.

The relative positioning mentioned above can be realized by means of forming, on a lower part of the inner wall of the tubular chilled mold, a refractory, heat-insulating cover extending from the corner of the tubular chilled mold and the refractory header plate toward the downstream of the tubular chilled mold.

The refractory, heat-insulating cover may be provided by a part of the refractory header plate or by securing a member integrally with the refractory header plate. Alternatively, castable refractory material may be applied and bonded to the inner wall of the tubular chilled mold to form the refractory, heat-insulating cover. In addition, flexible refractory, heat-insulating felt may be rigidly mounted on the inner wall of the tubular chilled mold.

The relative positioning mentioned above can also be realized by using a refractory header plate extending inwardly over the inner wall of the tubular chilled mold to form a recess around the inner wall of the tubular chilled mold and by introducing gas into a lower part of the recess relative to the central axis of the tubular chilled mold. The gas used may be air, nitrogen, argon, or other inert gases. The gas is preferably dried before used.

The means for introducing the gas may be a slit, minute pores, porous refractories, porous carbon, a silicon carbide based refractory material using the silicon nitride binder and the like. The dimensions of the slit should be determined so that the melt does intrude in it. The gas introduction means may be exposed to the recess at one or more parts thereof. More specifically, a plurality of slits or the like may be opened to the recess or a single slit may be opened to the recess. In the case of a plurality of slits or the like, they are preferably spaced equidistant to each other. In the case of a single slit or the like, it is preferably opened to the lowermost part of the mold, especially in the case of a round ingot.

Figure 1:
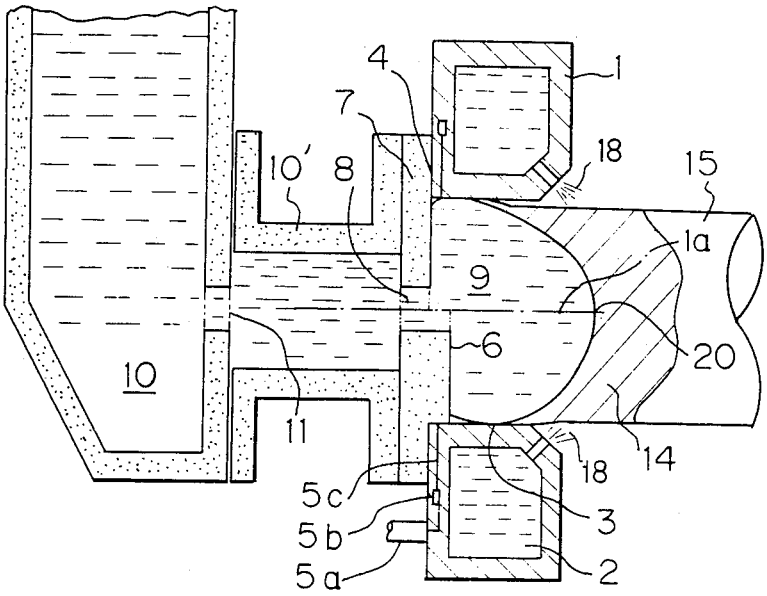
FIG. 1 is a longitudinal cross-sectional view of a horizontal continuous casting apparatus according to an embodiment of the present invention.

In FIG. 1, the essential parts of the horizontal continuous casting apparatus according to an example of the present invention as well as the molten metal and ingot are shown.

A tubular chilled mold 1 (hereinafter referred to as the mold 1) is made of aluminum alloy and is in an annular form. The mold 1 includes an annular inner space, i.e., a cooling water jacket 2. A cylindrical inner wall 3 of the mold is chilled by water in the cooling-water jacket 2.

The aluminum-alloy melt is fed from a melting and holding furnace (not shown), if necessary, through a degassing and slag-removal furnace, into a tundish 10.

The aluminum-alloy melt is maintained in the tundish 10 at a predetermined level. The aluminum-alloy melt is caused to flow successively through an outlet 11 of the tundish, a refractory conduit 10′, and a passageway 8 of a refractory header plate 7 into the mold 1. The refractory conduit 10′ is preferred, but can be omitted if necessary. The aluminum-alloy melt held and unsolidified within the mold 1 is denoted by 9. The outer periphery of the aluminum-alloy melt 9 is in contact with the inner cylindrical wall of the mold 1 and thus cooled to form the solidified shell. The thickness of the solidified shell increases while withdrawing the aluminum-alloy melt 9 from the mold 1 downstream. The skin of the solidified ingot 14 is denoted by 15. The metal body is directly cooled by cooling water 18 ejected from the cooling-water jacket 2 to form the solidified ingot 14, which is cylindrical in the example now described.

Lubricating oil is fed successively through a feeding conduit **5*a*, annular distributing conduit 5*b*, and slits 5*c* to the cylindrical inner wall 3 of the mold 1**.

In an embodiment according to the present invention, the lower part of the aluminum-alloy melt is displaced downstream relative to the upper part by means of a lug 6 which consists of refractory, heat-insulating material. The lug 6 is located beneath the central axis of the mold 1 and is secured to the refractory header plate 7 at its downstream side. As a result of forming the lug 6, the solidified shell of the lower part of the aluminum-alloy melt 9 starts to form downstream relative to the solidified shell at the upper part of the aluminum-alloy melt 9. The horizontal distance of the solidified shell-formation points depends upon the temperature and solidification characteristics of the aluminum alloy melt, the diameter of the solidified ingot 14, and the thermal balance of the mold assemblies.

Figure 2:
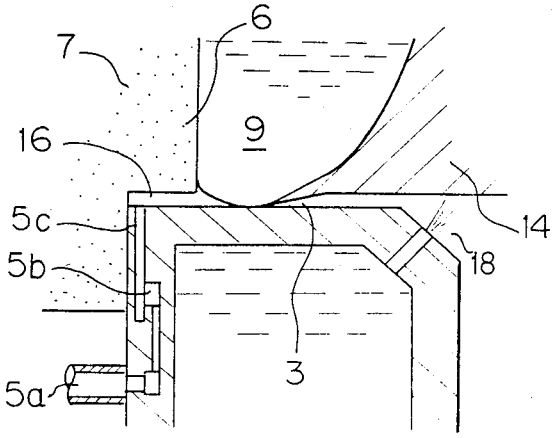
FIG. 2 is an enlarged partial view of the apparatus shown in FIG. 1 at the mold and its adjacent members.

FIG. 2 is an enlarged view of the mold 1. The refractory header plate 7 is an integral body which is machined to a shape as shown in FIG. 2, i.e., the lug part and the part to contact the mold 1. A refractory material commercially available under the trade name of Marinite (Johns Manville, Ltd., U.S.) is used for the refractory header plate 7. Marinite has wettability and corrosion resistance against the aluminum-alloy melt 9.

The refractory header plate 7 is secured to the mold 1 to provide a clearance 16 for passing lubricating oil, but not the melt. This clearance 16 is usually from N/10 mm to N/100 mm (N is an integer of from 1–9). The lubricating oil, which is fed form the feeding conduit 5*a* and which passes the annular distributing conduit 5*b* and then slits 5*c*, can therefore flow into the clearance 16 for distribution over the cylindrical inner wall 3. The cylindrical inner wall 3 is wetted by the lubricating oil flowing downward.

The clearance 16 (FIG. 2) need not be formed if that the lubricating oil can be fed to the cylindrical inner wall 3 by another means. For example, horizontal grooves (not shown) may be parallelly formed along one or both of the mold 1 and the refractory header plate 7, which are closely held without clearance, and the horizontal grooves communicated with the feeding conduit 5*a*.

Preferred shapes of the refractory, heat-insulating cover are explained with reference to FIGS. 3A through 3E.

The upper and lower drawings of FIGS. 3A through 3E represent the longitudinal and horizontal cross-sectional views, respectively. The horizontal plane across the central axis of the mold is denoted by 1*a*.

As shown in FIGS. 3A through 3E, the thickness of the refractory, heat-insulating cover, which is denoted by 17, decreases linearly (FIGS. 3A, 3E) or curved (FIGS. 3B, 3C, 3D) along the direction from the upstream end to the downstream end of the mold. The end shape of the refractory, heat-insulating cover 17 as seen in a plan view is rectangular (FIGS. 3A, 3B), a triangle having an apex on the central axis 1*a* (FIG. 3C), or a curve (FIGS. 3D, 3E) having an apex on the central axis 1*a* and, starting and ending at the refractory header plate 7.

Figure 3A:
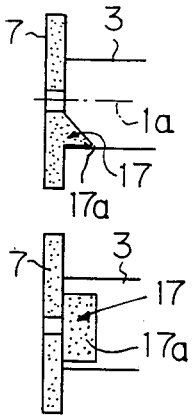
FIGS. 3A through 3E show various shapes of the refractory, heat-insulative cover according to the present invention.
Figure 3B:
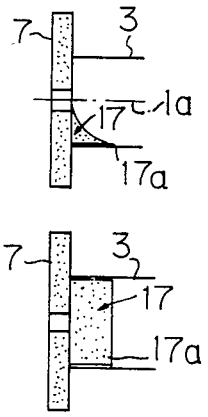
Figure 3C:
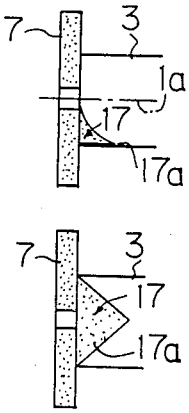
Figure 3D:
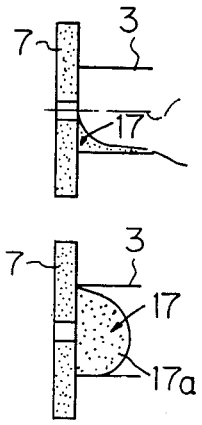
Figure 3E:
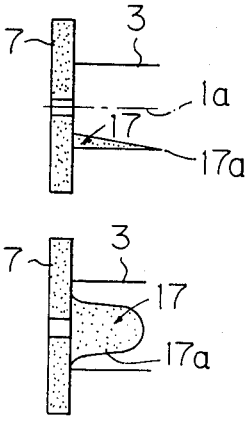

In the case of a cylindrical mold, it is preferred that the refractory, heat-insulating cover 17 have a downstream end 17*a* which, as seen in plan view, is curved, the apex of the curve being positioned on the central axis 1*a* of the mold (FIGS. 3D, 3E). In the case of rectangular mold, it is preferred that the refractory, heat insulating cover 17 have a downstream end 17*a* which, as seen in a plan view, has a rectangular shape (FIGS. 3A, 3B).

Figure 4:
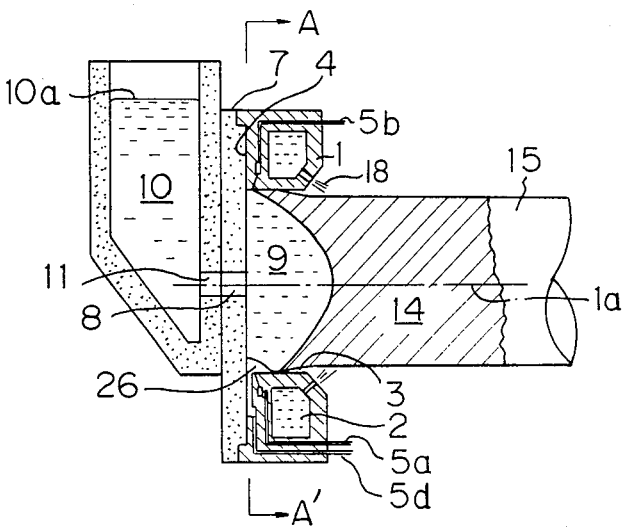
FIG. 4 is a longitudinal cross-sectional view of a horizontal continuous casting apparatus for producing a round strand, according to another embodiment of the present invention.

Referring to FIG. 4, another embodiment of the horizontal continuous casting apparatus according to the present invention is illustrated. The same reference numerals as those in FIG. 1 denote the same members.

The recess around the inner wall 3 of mold 1 is denoted by 26 and is formed by the inner wall 3 and the refractory header plate 7. The gas is introduced into a part of the recess 26 lower than the central axis 1*a* of the mold 1. The gas pressure generated in this recess 26 due to the gas introduction enables the horizontal displacement of a lower part of the molten metal 10.

Figure 5:
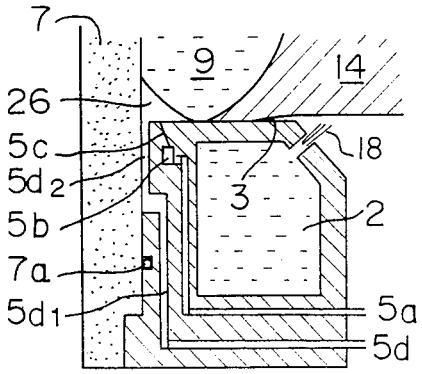
FIG. 5 is a drawing similar to FIG. 2, with regard to the apparatus shown in FIG. 4.

FIG. 5 is a drawing similar to FIG. 2. The same reference numerals as those of FIG. 2 denote the same members. The gas, i.e., the compressed air in this embodiment, is fed from a source (not shown) into the recess 26 as described below. The pressure and flow rate of the compressed air are controlled by a control device (not shown) to a predetermined value so as to provide a predetermined gas pressure in the recess 26. The compressed air is passed successively through the gas-introduction conduit 5*d*, the minute conduit $5d_1$, and the slit $5d_2$. The slit $5d_2$ is formed between the adjacent surfaces of the upstream side of the mold 1 and the downstream side of the refractory header plate 7. The compressed air from the slit $5d_2$ is then introduced to the recess 26 and forms a space at the recess 26, as shown in FIG. 5.

A preferable gas pressure is experimentally determined. In several aluminum alloys, the gas pressure preferably corresponds to the hydrostatic pressure of the aluminum alloy melt, which pressure being determined virtually by the height from the bottom of the inner wall 3 to the level 10*a* of the aluminum alloy melt maintained in the tundish 10. In the case of AA 4032 alloy, and similar alloys the gas pressure is preferably less than the hydrostatic pressure. The gas pressure is maintained by continuously feeding the gas.

According to an observation by the present inventors, the gas flows downstream from the recess 26. The passage way of gas may be between the inner wall 3 and the solidified shell or the skin of the ingot 14.

The gas pressure generated in the recess 26 is increased in accordance with the increase in the gas-flow rate. Such increase is lessened when the gas pressure arrives at the hydrostatic pressure. A gas pressure appreciably higher than the hydrostatic pressure is liable to cause breakout. In addition, the cast skin 15 is very liable to exhibit a ripple skin or a sticked skin, possibly because the gas flowing from the recess 26 downstreams stirs the outer peripheral surface of the aluminum alloy melt 9 and breaks the solidified shell, which is still thin during growth in the mold 1, thereby causing the melt to flow through the solidified shell. Alternatively, the gas may flow upward and then flow through a passageway which is formed between the upper part of the inner wall 3 and the aluminum-alloy melt 9. In this case, the cooling amount is disadvantageously suppressed at the upper part of the aluminum alloy melt 9.

The flow rate and pressure of the gas fed are determined experimentally. The optimum flow rate and pressure of the gas fed are dependent upon the kind, temperature, and solidification behavior of the aluminum-alloy melt, the cross-sectional shape and diameter of the ingot 14, and the thermal balance of the mold assemblies.

Figure 6:
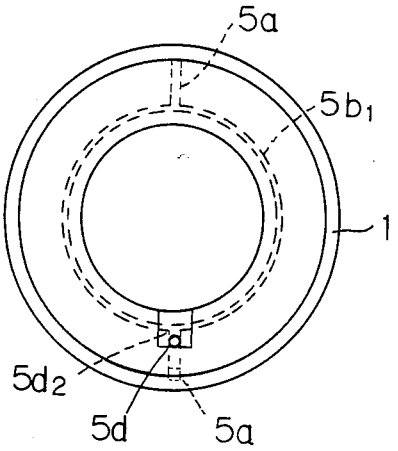
FIG. 6 is a side view of the mold at the lines A—A′ of FIG. 4.

FIG. 6 is a side view of the mold 1 as seen along the line A—A'.

As is apparent, the slit 5*d*, is communicated to the inner corner at the bottom of mold 1. The gas passes through the introduction conduit 5*d* and applies pressure to the metal body at the lowest part of the mold 1. The two oil-feeding conduits 5*a* are communicated with the annular distributing conduit 5*b* at the uppermost and lowermost parts of the mold 1, respectively. The lubricating oil is uniformly fed from the slits and then distributed over the inner circumferential part of the mold.

Figure 7:
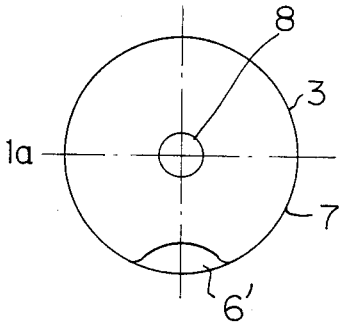
FIG. 7 is a side view of the refractory sheet body shown in FIG. 4 at its side adjacent to the mold.

Referring to FIG. 7, in which the refractory header plate 7 is shown from the mold side, the gas space which is formed due to the pressure application is denoted by 6′. The gas space 6′ is formed on the lowermost part of the mold.

Figure 8:
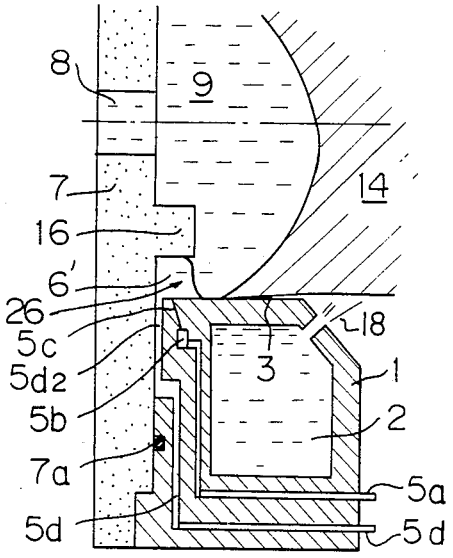
FIG. 8 shows essential parts of the horizontal continuous casting apparatus for producing a round strand, according to a further embodiment of the present invention.

Referring to FIG. 8, a further embodiment of the apparatus according to the present invention is illustrated. The refractory header plate is provided with eaves 16. The eaves 16 extend from the refractory header plate 7 and form an overhang over a part of the recess 26 beneath the central axis 1*a*. The gas introduced from the slit $5d_2$ is held beneath the eaves 16 and forms the gas space at the recess 26, thereby preventing the ascent of gas.

Figure 9:
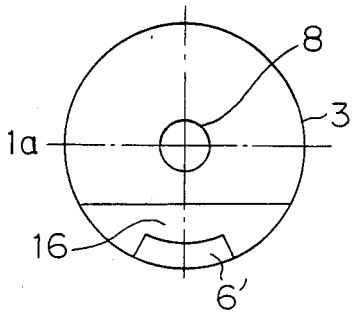
FIG. 9 is a side view of the refractory sheet body shown in FIG. 8 at its side adjacent to the mold.

Referring to FIG. 9, in which the refractory, header-plate 7 is shown from the mold side, the gas space 6′ is formed in the concave part of the refractory, header-plate 7, defined by the eaves 16. That is, the recess, where the gas space if formed due to the pressure application, is determined by the shape of the refractory, header-plate to form the eaves 16. This formation can be easily accomplished by removing the bottom part of, e.g., a Marinite disc.

According to the embodiment shown in FIGS. 8 and 9, the gas space 6′ can be specified. In addition, it is possible to prevent the gas from ascending from the gas space 6′.

A constant gas pressure can therefore be easily maintained.

Figure 10:
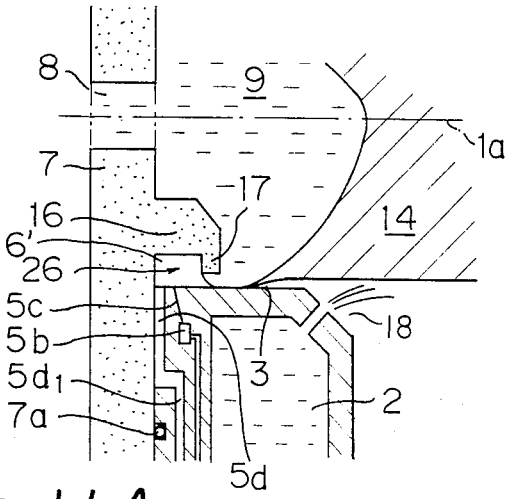
FIG. 10 is a drawing similar to FIG. 8 and shows eaves improved over those shown in FIG. 8.

FIG. 10 illustrates eaves 16 improved over those shown in FIG. 9. The eaves 16 have a downwardly protruding projection 17 at the front end thereof. The projection 17 protrudes toward the inner wall 3 of the mold 1. The effect of preventing the gas ascent can be furthermore enhanced by the projection 17. The gas space 6′ can be formed in the space surrounded by the refractory, header-plate 7, the eaves 16, and the projection 17.

Figure 11A:
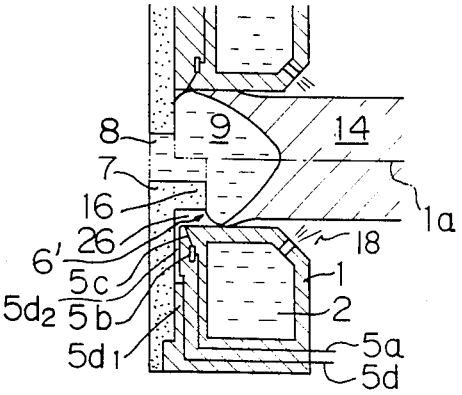
FIG. 11A is a longitudinal cross-sectional view of the horizontal continuous casting apparatus for producing a square strand, according to a yet further embodiment of the present invention.
Figure 11B:
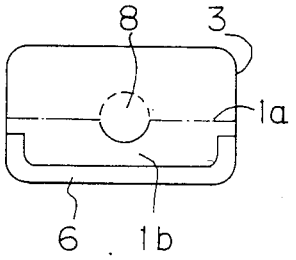
FIG. 11B is a side view of the refractory sheet body shown in FIG. 11A at the side adjacent to the mold.

FIGS. 11A and 11B show an embodiment of the horizontal continuous casting apparatus for producing a rectangular columnar ingot, particularly, the eaves 16 preferred for the casting of a rectangular columnar strand. The gas space 6′, which is formed by the gas application, extends over the lowermost side and a part of the lateral sides of the ingot 1, because the eaves 16 define the recess 6 having a configuration as shown in FIG. 11B.

The present invention is further explained by way of the following examples.

EXAMPLE 1

The apparatus shown in FIGS. 1 and 2 was used to continuously cast 2-inch and 8-inch diameter ingots made of AA 6061 aluminum alloys. The ingots could be produced without operation troubles, such as breakout, and exhibited skin which was smooth and uniform around the entire circumference thereof and metallurgical internal qualities which were homogeneous and excellent.

EXAMPLE 2

The apparatus shown in FIG. 4 was used to continuously cast 2-inch diameter ingots made of AA 2218 aluminum alloy.

The ingots could be produced without operation troubles, such as breakout, and exhibited skin which was smooth and uniform around the entire circumference thereof and metallurgical internal qualities which were homogeneous and excellent.

EXAMPLE 3

The apparatus shown in FIG. 8 was used to continuously cast 8-inch diameter ingots made of AA 6061 aluminum alloy.

The ingots could be produced without operation troubles, such as breakout, and exhibited skin which was smooth and uniform around the entire circumference thereof and metallurgical internal qualities which were homogeneous and excellent.

EXAMPLE 4

The apparatus shown in FIG. 10 was used to continuously cast 4-inch diameter ingots made of AA 4032 aluminum alloy.

The ingots could be produced without operation troubles, such as breakout, and exhibited skin which was smooth and uniform around the entire circumference thereof and metallurgical internal qualities which were homogeneous and excellent.

The casting conditions of the above four examples are given in Table 1.

| | Example Nos. | | | |
|---|---|---|---|---|
| | 1 | 2 | 3 | 4 |
| A. Alloy designation | AA. 606F3 | AA. 2218 | AA. 6061 | AA. 4032 |
| B. Composition (wt. %) | Si 0.5<br>Mg 0.9<br>Cr 0.1<br>Cu 0.3<br>Fe 0.3<br>Al Bal. | Cu 4.0<br>Mg 1.5<br>Ni 2.1<br>Fe 0.3<br>Si 0.2<br>Al Bal. | Si 0.5<br>Mg 0.9<br>Cr 0.1<br>Cu 0.3<br>Fe 0.3<br>Al Bal. | Si 11.7<br>Mg 1.0<br>Cu 0.8<br>Ni 0.8<br>Fe 0.4<br>Al Bal. |
| C. Temperature alloy melt C.° | 680 | 670 | 680 | 630 |
| D. Cross-Section of the mold; diameter | Columnar<br>2 inchϕ | Columnar<br>2 inchϕ | Columnar<br>8 inchϕ | Columnar<br>4 inchϕ |
| E. Casting Apparatus | FIG. 1, 2 (horizontal length of lug 6–5 mm) | FIG. 4 | FIG. 8 | FIG. 10 |
| F. Casting Speed mm/min. | 600 | 600 | 150 | 400 |
| G. Lubricating oil | Castor oil | Castor oil | Castor oil | Castor oil |
| H. Temperature of Cooling Water | 14 | 15 | 15 | 15 |
| I. Rate of Supplying Cooling | 30 | 30 | 150 | 80 |

-continued

| | Example Nos. | | | |
|---|---|---|---|---|
| | 1 | 2 | 3 | 4 |
| Water l/min. | | | | |
| J. Introduced Gas | none | Air | Nitrogen | Air |
| K. Rate of Gas Flow l/min | none | 500 | 500 | 100 |
| L. Applied Gas Pressure mm water | none | 420 | 570 | 275 |
| M. Metal Level (H; mm $H_2O$) in Tundish | 480 | 480 | 580 | 480 |
| N. Bilet Surface | Smooth | Smooth | Smooth | Smooth |

EXAMPLE 5

(Comparative Example)

The ingots mentioned in Example 1 were produced by a conventional horizontal continuous casting apparatus with neither the lug nor the gas application. The skin of ingots conspicuously exhibited sticking marks at the lower part thereof. In addition, the solidification center of the ingots was offset upward. The internal metallurgical structure was not homogeneous.

As clear from the above, the essence of the present invention resides in the suppression of cooling of the metal body at its lower part relative to the upper part as seen from a horizontal plane across the central axis of tubular chilled mold. This has the following advantages.

A. The skin of the ingot is uniform and smooth over its entire circumference, which reduces the thickness of skin which has to be removed prior to the plastic working of the ingot.

B. The end point of solidification does not offset relative to the central axis of the tubular chilled mold, which provides an ingot with a homogeneous structure over the entire cross-section of the ingot.

C. The cooling is uniform and the lubricating oil is uniformly distributed, which prevents such operation troubles as breakout due to sticking and thus enhances productivity and reduces production costs.

What is claimed is:

1. An apparatus for the horizontal continuous casting of aluminum alloy metal, comprising:

a tundish for maintaining molten aluminum alloy, having an outlet;

a tubular chilled mold having (a) open ends, one of the open ends being in communication with the outlet of the tundish, (b) an axis extending essentially horizontally, and (c) an inner wall;

a refractory header plate which is placed between said tundish and said tubular chilled mold and has a passageway to the tubular chilled mold, said refractory header plate having a straight eave portion only beneath the central axis of the mold extending inwardly over the inner wall of the tubular chilled mold to form a recess over a lower portion of the tubular chilled mold; and a means for introducing gas into said recess for horizontally displacing a lower contact part of the molten aluminum alloy along the inner wall of the tubular chilled mold relative to an upper contract part, so that said lower contact part is positioned downstream relative to said upper part, said lower contact part being beneath a horizontal plane across the central axis, said means for introducing gas including means for controlling pressure of the introducing gas relative to a hydrosatic pressure of the melt contained in the tundish and depending upon the aluminum alloy melt, to a predetermined value approximately equal to said hydrostatic pressure, so that an unbalanced cooling of the aluminum alloy body over a circumference of the mold is mitigated.

* * * * *